US005626337A

United States Patent [19]

Iseki

[11] Patent Number: 5,626,337

[45] Date of Patent: May 6, 1997

[54] BELT FEEDING DEVICE

[75] Inventor: Shuji Iseki, Ebina, Japan

[73] Assignee: Fuji Xerox Co., Ltd., Tokyo, Japan

[21] Appl. No.: 417,039

[22] Filed: Apr. 5, 1995

[30] Foreign Application Priority Data

May 10, 1994 [JP] Japan ..... 6-096652

[51] Int. Cl.[6] ..... B65H 43/04

[52] U.S. Cl. ..... 271/198; 198/840

[58] Field of Search ..... 271/198, 275, 271/264; 198/806, 840, 842, 835, 843, 824

[56] References Cited

U.S. PATENT DOCUMENTS

| | | | |
|---|---|---|---|
| 857,610 | 6/1907 | Dull | 198/843 |
| 1,980,777 | 11/1934 | Zollinger | 198/842 |
| 2,484,752 | 10/1949 | Searles | 198/842 |
| 2,743,810 | 5/1956 | Armstrong | 198/843 |
| 2,925,168 | 2/1960 | Lorig | 198/843 |
| 3,221,868 | 12/1965 | Rickek et al. | 198/824 |
| 3,961,736 | 6/1976 | Fatula | 198/842 |
| 3,980,174 | 9/1976 | Conrad | 198/840 |
| 4,011,939 | 3/1977 | Conrad | 198/840 |
| 4,174,171 | 11/1979 | Hamaker et al. | 198/806 |
| 4,221,480 | 9/1980 | Spehrley, Jr. | 198/840 |
| 4,438,617 | 3/1984 | Ulrich et al. | 198/840 |
| 4,832,186 | 5/1989 | Conrad | 198/806 |
| 5,213,202 | 5/1993 | Arnold | 198/835 |
| 5,282,532 | 2/1994 | Thomas, Sr. | 198/835 |

FOREIGN PATENT DOCUMENTS

| | | |
|---|---|---|
| 5-319611 | 12/1993 | Japan . |
| WO93/02956 | 2/1993 | WIPO . |

*Primary Examiner*—William E. Terrell
*Assistant Examiner*—T. Kelly
*Attorney, Agent, or Firm*—Oliff & Berridge

[57] ABSTRACT

A belt feeding device including a plurality of elastic rolls each having a plurality of disklike elastic fins arranged in an axial direction, and a belt member wrapped around a plurality of rolls inclusive of the elastic rolls and adapted to be circularly moved. Each elastic roll is formed by finishing the outer circumferential surfaces of the elastic fins to a given outer diameter with a given directionality from one axial end to the other axial end of the roll, and the given directionality of finishing of at least one of the elastic rolls is opposite to that of the other elastic rolls. Accordingly, the walk of the belt member due to the incompleteness of forming of the elastic roll around which the belt member is wrapped can be prevented to reduce an edge force acting on the side edge of the belt member.

8 Claims, 6 Drawing Sheets

BELT FEEDING DEVICE

BACKGROUND OF THE INVENTION

1. Field of the Invention

The present invention relates to a belt feeding device for rotating an endless belt member such as a recording sheet feeding belt or a photosensitive belt in a color image forming apparatus or the like, and more particularly to an improvement in such a belt feeding device having means for preventing meander of the endless belt member.

2. Description of the Related Art

Such a belt feeding device having means for preventing meander of the endless belt member is known from Japanese patent Laid-open No. Hei 5-319611, for example.

In the belt feeding device, the belt member is wrapped around a driving roll and a plurality of driven rolls, and is circularly moved at a given speed by rotating the driving roll. One of the driven rolls is used as an edge guide roll for guiding a side edge of the belt member, thereby preventing meander of the belt member.

FIG. 7 shows the edge guide roll and its peripheral equipment. Referring to FIG. 7, reference numeral 50 denotes the edge guide roll; reference numeral 51 denotes the belt member adapted to be moved in the direction shown by an arrow A; and reference numeral 52 denotes an edge guide mounted in the vicinity of one axial end of the edge guide roll 50. The edge guide 52 is movable in the axial direction of the edge guide roll 50 (i.e., the direction shown by an arrow B), and is biased to the belt member 51 by means of a spring 53. The spring 53 is provided with an adjuster mechanism 54 for freely adjusting a biasing force of the spring 53.

As shown in FIGS. 7 and 8, the edge guide roll 50 is an elastic roll formed by axially arranging a plurality of disk-like elastic fins 50*a* on the outer circumferential surface of a rotating shaft 50*b*. The elastic fins 50*a* at the same axial position on the rotating shaft 50*b* are equally spaced in the circumferential direction of the rotating shaft 50*b*. Further, the edge guide roll 50 is inclined at a slight angle to the driving roll (not shown) so that when the belt member 51 is rotated, it is always offset to the edge guide 52 in the axial direction of the edge guide roll 50 (this offset will be hereinafter referred to as belt walk).

Accordingly, the belt member 51 is rotated in such a manner that a side edge 51*a* thereof always slides on the edge guide 52. At this time, the biasing force of the edge guide 52 is adjusted to balance a force of offset of the belt member 51 to the edge guide 52 (this force of offset will be hereinafter referred to as a walk force), thereby completely canceling the belt walk of the belt member 51.

Such forcible stop of the belt walk of the belt member 51 by the edge guide 52 causes a reaction of the walk force against the side edge 51*a* of the belt member 51 sliding on the edge guide 52 (this reaction will be hereinafter referred to as an edge force), and it is considered that the side edge 51*a* of the belt member 51 may be damaged (buckled, cracked, etc.) by the edge force. However, since the elastic roll is used as the edge guide roll 50 in this belt feeding device as mentioned above, the elastic fins 50*a* of the edge guide roll 50 are elastically deformed in the axial direction of the edge guide roll 50 upon application of the edge force to the side edge 51*a* of the belt member 51, thereby reducing the edge force applied to the side edge 51*a*. Accordingly, although the belt walk of the belt member 51 is forcibly stopped by the edge guide 52, the damage to the side edge 51*a* of the belt member 51 can be prevented.

Further, the above-cited literature also discloses an embodiment wherein no angular difference in arrangement between the edge guide roll and the driving roll is given, but a pair of edge guides are provided at both side edges of the belt member.

The elastic roll is conventionally manufactured by performing injection molding of a soft material such as rubber or synthetic resin to form the elastic fins 50*b* projecting from the outer circumferential surface of the rotating shaft 50*a*, and then grinding or cutting the outer circumferential surface of each elastic fin 50*b* by moving a tool from one axial end to the other axial end of the rotating shaft 50*a* to thereby finish the outer circumferential surface of each elastic fin 50*b* to a given outer diameter.

As mentioned above, the outer circumferential surface of each elastic fin 50*b* is ground or cut by moving the tool from one axial end to the other axial end of the rotating shaft 50*a* in finishing the outer circumferential surface of each elastic fin 50*b* to the given outer diameter according to this manufacturing step for the elastic roll. Accordingly, each elastic fin 50*b* is deformed in the same direction as the direction of movement of the tool during the finishing step. As a result, the outer circumferential surface of each elastic fin 50*b* is taperingly ground or cut by the tool as shown in FIG. 9.

Accordingly, when the belt member 51 is wrapped around this elastic roll manufactured by the above method to construct the belt feeding device, each elastic fin 50*b* is pressed to be deformed by the belt member 51 as shown in FIG. 10 and resultantly acts to move the belt member 51 in such a direction as to cancel this deformation. That is, each elastic fin 50*b* generates a walk force acting on the belt member 51 in the direction shown by an arrow C in FIG. 10 opposite to the direction of movement of the tool that finished the outer circumferential surface of each elastic fin 50*b* to the given outer diameter, thus generating the belt walk. As a result, the edge force acting from the edge guide 52 to the side edge 51*a* of the belt member 51 is increased to reduce the effect of the elastic roll intended to reduce the edge force.

SUMMARY OF THE INVENTION

It is accordingly an object of the present invention to provide a belt feeding device which can prevent the walk of the belt member due to the incompleteness of forming of the elastic roll around which the belt member is wrapped and can reduce the edge force acting on the side edge of the belt member.

According to the present invention, in a belt feeding device including a plurality of elastic rolls each having a plurality of disklike elastic fins arranged in an axial direction, and a belt member wrapped around a plurality of rolls inclusive of the elastic rolls and adapted to be circularly moved; the following technical means are applied.

The first technical means is characterized in that each elastic roll comprises a roll formed by finishing the outer circumferential surfaces of the elastic fins to a given outer diameter with a given directionality from one axial end to the other axial end of the roll, that is, an elastic roll obtained by the conventional manufacturing method mentioned above, and that the given directionality of finishing of at least one of the elastic rolls is opposite to that of the other elastic rolls.

The second technical means is characterized in that each elastic roll comprises a roll formed by finishing the outer circumferential surfaces of the elastic fins to a given outer diameter with a first directionality between one axial end and the axial center of the roll and with a second directionality opposite to the first directionality between the axial center and the other axial end of the roll.

The third technical means is characterized in that each elastic roll comprises a roll formed by forming a plurality of annular grooves at axially equal intervals on the outer circumferential surface of a columnar roll whose outer circumferential surface is preliminarily finished to a given outer diameter.

In these technical means, all the plural rolls around which the belt member is wrapped may be the elastic rolls; however, it is preferable that a driving roll as one of the plural rolls for transmitting torque of a motor to the belt member is a rigid roll (e.g., a metal roll or a rubber coated metal roll) less fluctuated in its outer diameter, from the viewpoint of stabilization of a feed speed of the belt member.

According to the first technical means, the outer circumferential surfaces of the elastic fins of each elastic roll around which the belt member is wrapped are finished to a given outer diameter with a given directionality from one axial end to the other axial end of the elastic roll. Accordingly, the elastic fins of each elastic roll applies a walk force to the belt member in a direction opposite to the direction of finishing of the elastic fins as in the related art. However, since the given directionality of finishing of at least one of the elastic rolls is opposite to that of the other elastic rolls according to this technical means, the elastic fins of the at least one elastic roll generate belt walk in a direction opposite to the direction of belt walk generated by the elastic fins of the other elastic rolls. Accordingly, the belt walk due to the incompleteness of forming of the elastic rolls is canceled totally in the belt feeding device, thus reducing the edge force acting on the side edge of the belt member.

According to the second technical means, the outer circumferential surfaces of the elastic fins of each elastic roll around which the belt member is wrapped are finished to a given outer diameter with a first directionality between one axial end and the axial center of the elastic roll and with a second directionality opposite to the first directionality between the axial center and the other axial end of the elastic roll. Accordingly, the elastic fins provided between one axial end and the axial center of each elastic roll and the elastic fins provided between the axial center and the other axial end of each elastic roll generate belt walk in opposite directions. Accordingly, the belt walk due to the incompleteness of forming of the elastic rolls is canceled individually in each elastic roll, thus reducing the edge force acting on the side edge of the belt member.

According to the third technical means, the elastic fins of each elastic roll are formed by forming a plurality of annular grooves at axially equal intervals on the outer circumferential surface of a columnar roll whose outer circumferential surface is preliminarily finished to a given outer diameter. Accordingly, it is unnecessary to finish the outer circumferential surfaces of the elastic fins to a given outer diameter after forming the elastic fins. In other words, there is no possibility that the outer circumferential surfaces of the elastic fins become tapered. As a result, there is no possibility of the belt walk due to the incompleteness of forming of the elastic rolls, thus reducing the edge force acting on the side edge of the belt member.

As described above, according to the belt feeding device of the present invention, the belt walk of the belt member due to the incompleteness of forming of the elastic rolls can be prevented by each technical means mentioned above, thus reducing the edge force acting on the side edge of the belt member. Accordingly, damage to the belt member can be greatly prevented.

Other objects and features of the invention will be more fully understood from the following detailed description and appended claims when taken with the accompanying drawings.

DETAILED DESCRIPTION OF THE PREFERRED EMBODIMENTS

Figure 1:
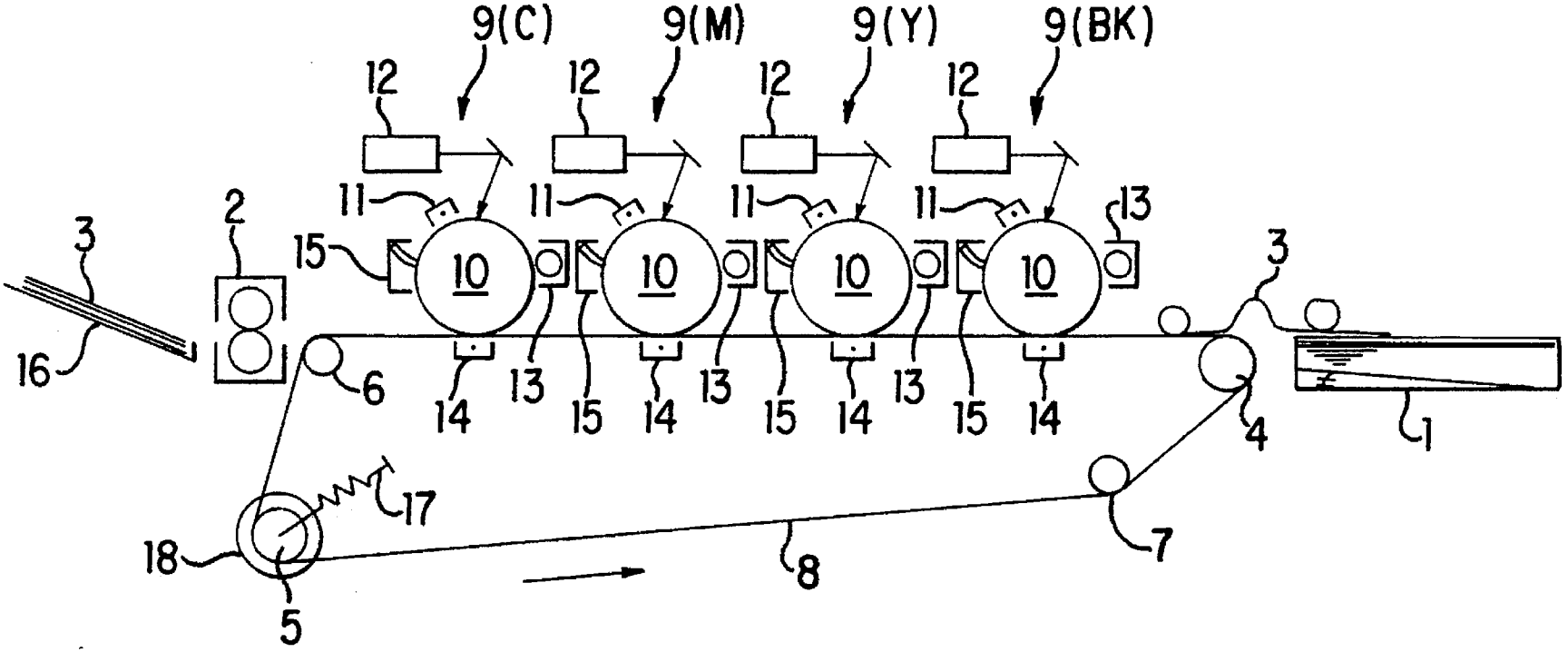
FIG. 1 is a schematic side view of a color electrophotographic copying machine employing the belt feeding device of the present invention used for feeding of a recording sheet.

Referring to FIG. 1, there is shown a color electrophotographic copying machine employing the belt feeding device of the present invention used for feeding of a recording sheet.

In the copying machine shown in FIG. 1, an endless belt member 8 is wrapped under tension around a driving roll 4, an edge guide roll 5, and driven rolls 6 and 7 in a feed path of a recording sheet 3 between a recording sheet supply tray 1 and a fuser 2. Four sets of image forming units 9 for forming toner images (visible images) corresponding to four colors of black BK, yellow Y, magenta M, and cyan C by an electrophotographic process are located at given intervals in the feed path of the recording sheet 3.

Each image forming unit 9 is constructed by arranging a charging unit 11, a laser beam scanning unit 12, a developing unit 13, a transfer corotron 14, and a cleaner 15 around a photosensitive drum 10. A toner image corresponding to image information in each color is formed on the photosensitive drum 10, and is then transferred to the recording sheet 3 fed by the belt member 8.

The recording sheet 3 fed from the supply tray 1 is supported on the belt member 8 at a given timing, and sequentially receives the toner images corresponding to the four colors transferred from the photosensitive drums 10 of the image forming units 9 during the movement of the belt member 8, thus carrying a full-color toner image on the recording sheet 3. After the transfer of the toner images, the recording sheet 3 is separated from the belt member 8, and is then fed through the fuser 2 to an eject tray 16. Thus, the formation of a color recorded image is completed.

Now, there will be described specific embodiments of the belt feeding device of the present invention employed in the color electrophotographic copying machine mentioned above.

First preferred Embodiment

Figure 7:
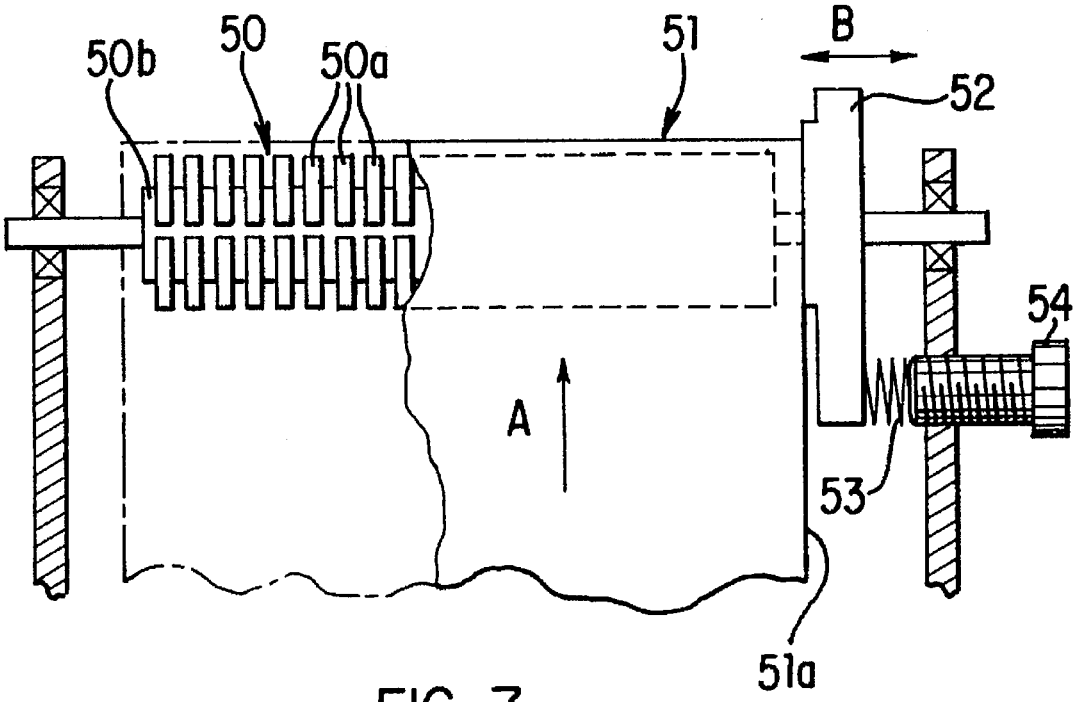
FIG. 7 Related Art
FIG. 7 is an elevational view showing the structure of an elastic roll as an edge guide roll in the related art.
Figure 8:
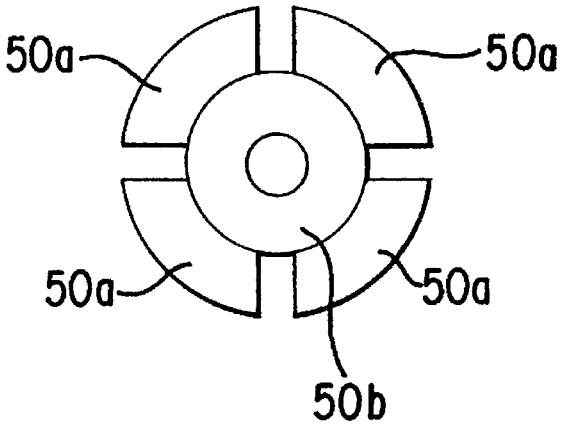
FIG. 8 Related Art
FIG. 8 is a side view of the elastic roll shown in FIG. 7.

In this color electrophotographic copying machine, the toner images are sequentially transferred to the recording sheet 3 as being fed by the belt member 8. Accordingly, if the belt walk of the belt member 8 occurs, the toner images corresponding to the four colors multi-transferred to the recording sheet 3 are finely misregistered in color. To cope with this, an edge guide 18 is provided at an axial end of the edge guide roll 5, so that a side edge of the belt member 8 is kept in sliding contact with the edge guide 18 during the movement of the belt member 8, thereby preventing the belt walk. The detailed structure of the edge guide 18 is similar to that in the related art previously described with reference to FIG. 7, and the description thereof will be omitted herein.

The driving roll 4 connected to a motor (not shown) is a metal roll whose outer circumferential surface is ground or cut to have a given outer diameter, in order to prevent fluctuations in moving speed of the belt member 8.

On the other hand, the other rolls except the driving roll 4 constituting the plural rolls around which the belt member 8 is wrapped, that is, the edge guide roll 5 and the driven rolls 6 and 7 are elastic rolls similar to those in the related art previously mentioned, in order to reduce the edge force acting on the side edge of the belt member 8 from the edge guide 18. Further, the edge guide roll 5 is biased from the inside to the outside of the belt member 8 by means of a spring 17, in order to give a fixed tension to the belt member 8.

Figure 2:
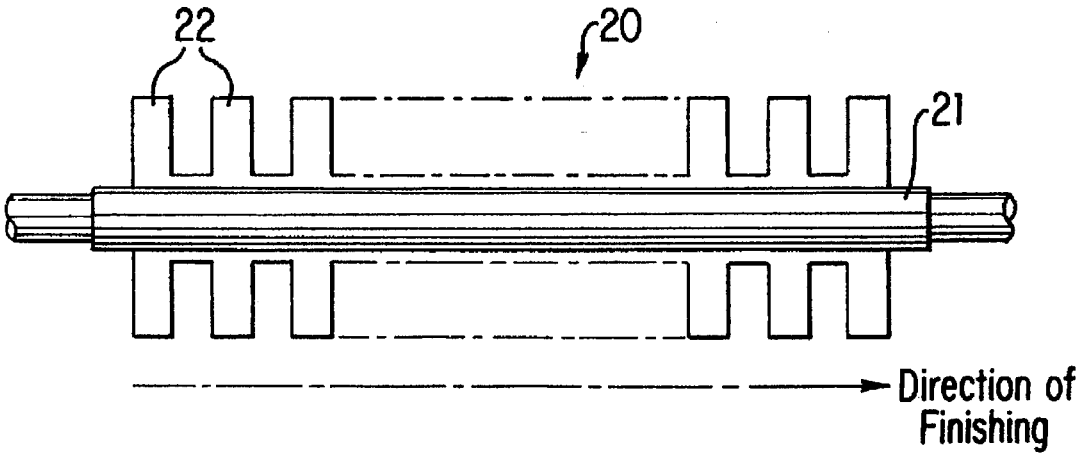
FIG. 2 is an elevational view of an elastic roll used in a first preferred embodiment of the belt feeding device of the present invention.
Figure 3:
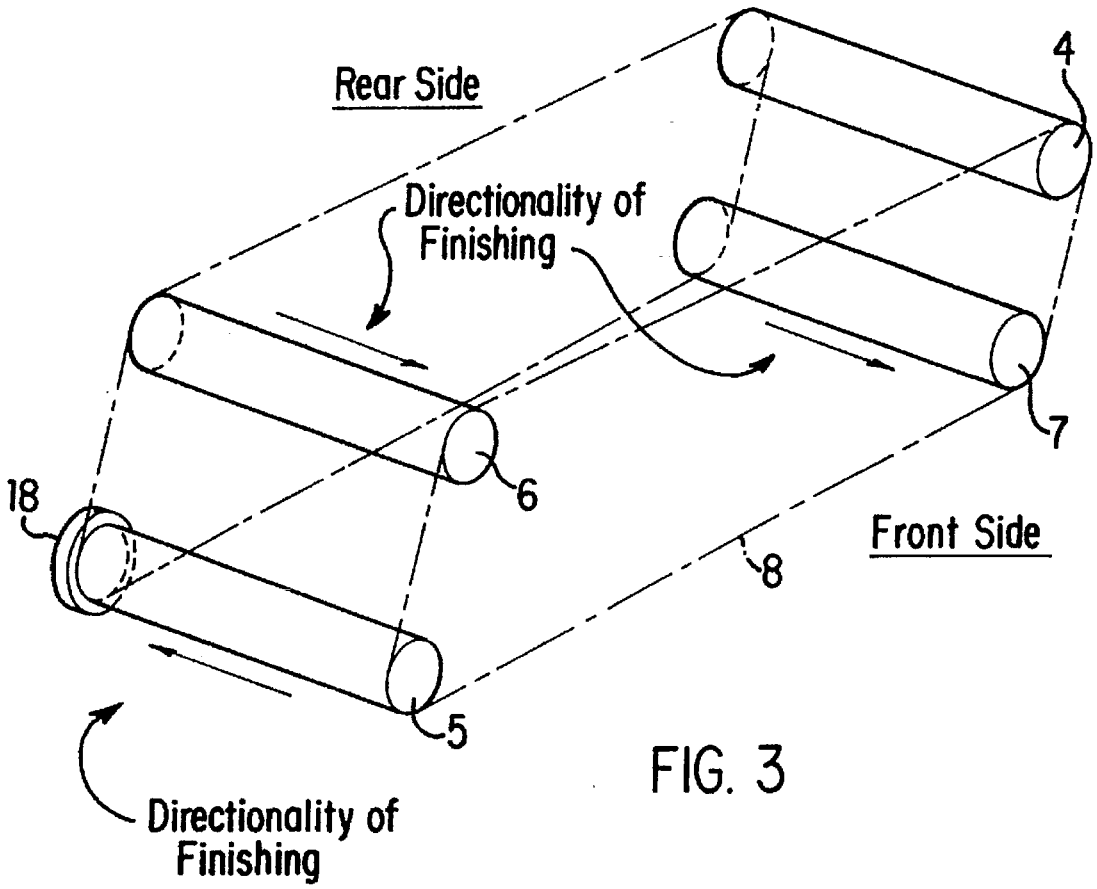
FIG. 3 is a perspective view showing the arrangement of driving and driven rolls in the belt feeding device according to the first preferred embodiment.

FIG. 2 shows an elastic roll 20 used in this preferred embodiment. The elastic roll 20 is composed of a rotating shaft 21 and a plurality of disklike or disc-shaped elastic fins 22 arranged in the axial direction of the rotating shaft 21. Each elastic fin 22 shown in FIG. 2 is circumferentially equally divided into a plurality of parts. The elastic roll 20 is formed by performing injection molding of rubber or soft synthetic resin around the rotating shaft 21 to form the elastic fins 22 and then grinding or cutting the outer circumferential surfaces of the elastic fins 22 to a given outer diameter.

Figure 9:
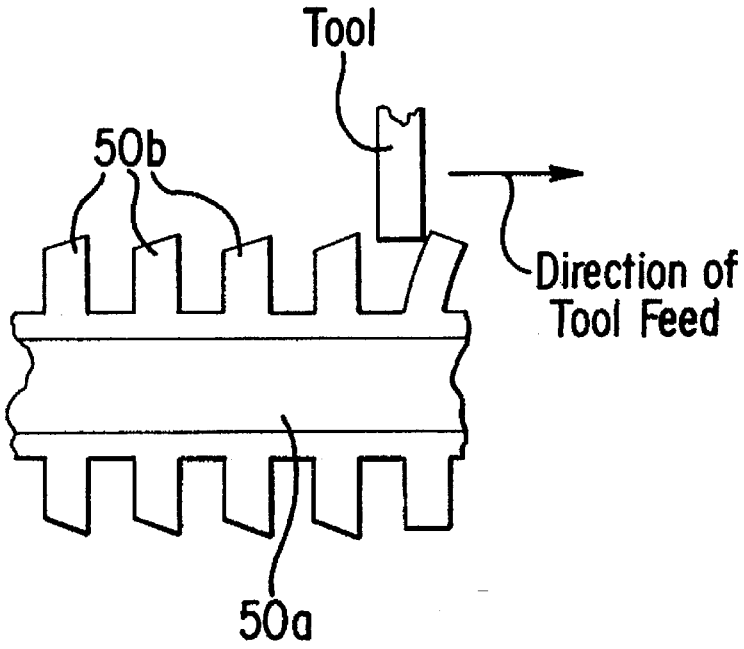
FIG. 9 Related Art
FIG. 9 is a fragmentary enlarged view showing the shape of elastic fins of the elastic roll shown in FIG. 7.
Figure 10:
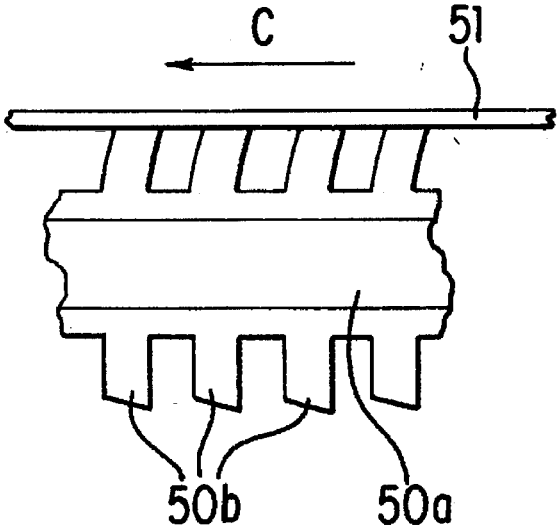
FIG. 10 is a fragmentary enlarged view showing a condition that the elastic fins shown in FIG. 9 give a walk force to a belt member.

This grinding or cutting is performed by feeding a tool from one axial end to the other axial end of the elastic roll 20, and resultantly the outer circumferential surface of each elastic fin 22 becomes tapered ( angled with respect to the axis of the roll or shaft 21) according to the direction of feeding of the tool as shown in FIG. 9. Accordingly, when the belt member 8 is wrapped around the elastic roll 20 having such a tapered shape of each elastic fin 22, the belt walk occurs in a direction opposite to the tool feeding direction (see FIG. 10), and the magnitude of the belt walk varies with a tapering angle of each elastic fin 22. Thus, each elastic roll 20 used as the edge guide roll 5 and the driven rolls 6 and 7 has a given directionality of finishing of the elastic fins 22 which causes the belt walk, and the intensity of the given directionality (size of angle or taper with respect to axis of roll) of each elastic roll 20 is different.

According to this preferred embodiment, in constructing the belt feeding device with such elastic rolls, the directionality of finishing of the elastic fins of at least one elastic roll of the plural elastic rolls around which the belt member is wrapped is set opposite to the directionality (angle) of finishing of the elastic fins of the other elastic rolls. For example, when the elastic rolls 20 used as the driven rolls 6 and 7 have the directionality of finishing from the rear side to the front side of the copying machine, the directionality of finishing of the elastic fins 22 of the elastic roll 20 used as the edge guide roll 5 is made to point from the front side to the rear side of the copying machine.

Further, regarding all the elastic rolls 20 used in the belt feeding device, if the total intensity of the directionality of finishing from the front side to the rear side is largely different from the total intensity of the directionality of finishing from the rear side to the front side, the belt walk of the belt member 8 toward either the front side or the rear side resultantly occurs. To cope with this, the total intensity of the directionality (size of angle or taper with respect to axis of roll) from the front side to the rear side is made substantially equal to that from the rear side to the front side in this preferred embodiment.

Figure 4:
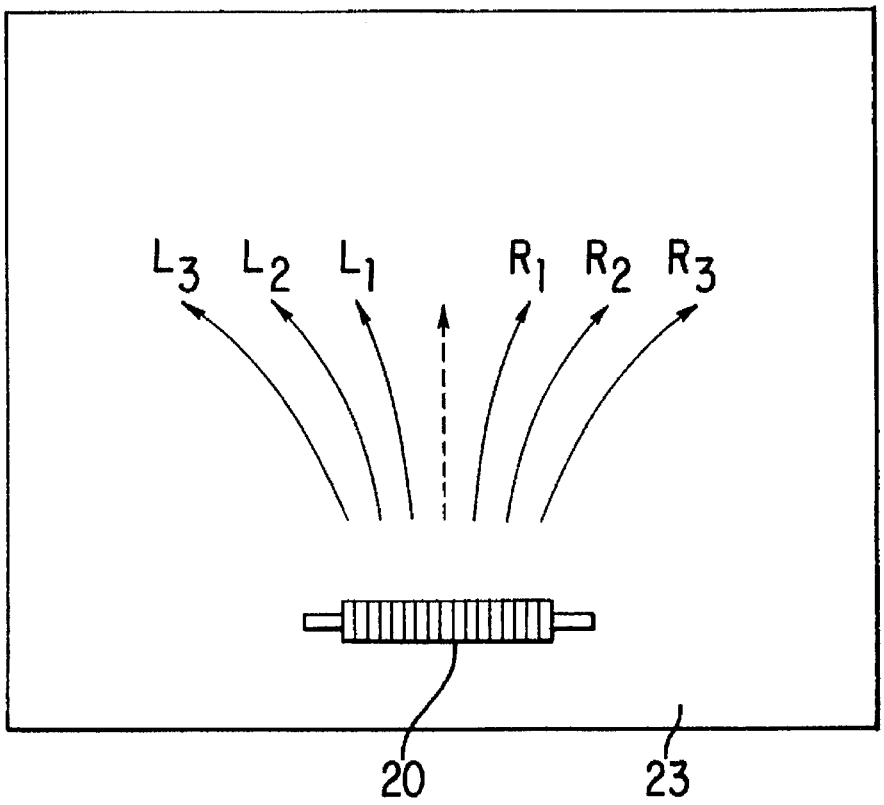
FIG. 4 is a schematic plan view illustrating a measuring method for the elastic roll according to the first preferred embodiment.

The directionality of finishing of each elastic roll and its intensity cannot be determined from the appearance. Accordingly, prior to constructing the belt feeding device, the directionality of finishing of each elastic roll 20 and its intensity are preliminarily measured. Then, the belt feeding device is constructed according to the result of measurement. The measurement is made by a method as shown in FIG. 4 such that each elastic roll 20 is rolled on a surface plate 23 to determine the directionality of finishing according to the direction of turn of each elastic roll 20 and also determine the intensity of the directionality according to the axial displacement of each elastic roll 20. That is, when the elastic roll 20 is rolled to go straight as shown by a broken line in FIG. 4, the belt walk of the belt member 8 does not occur, whereas when the elastic roll 20 is rolled to turn to the right or the left as shown by a solid line in FIG. 4, the belt walk of the belt member 8 occurs in the same direction as the direction of turn of the elastic roll 20. Further, when the axial displacement of the elastic roll 20 rolled on the surface plate 23 is large, the magnitude of the belt walk of the belt member 8 becomes large.

The result of measurement to each elastic roll 20 is recorded as, for example, $L_1$, $L_2$, or $L_3$ for the left turn or $R_1$, $R_2$, or $R_3$ for the right turn according to the direction of turn and the axial displacement.

Accordingly, in constructing the belt feeding device according to this preferred embodiment, the elastic rolls 20 to be used as the edge guide roll 5 and the driven rolls 6 and 7 are selected so that the intensities of the opposite directionalities in the belt feeding device as a whole are made substantially equal to each other on the basis of the result of measurement recorded for each elastic roll 20. For example, when the elastic rolls 20 recorded as $L_1$ and $L_2$ are used as the driven rolls 6 and 7, respectively, the elastic roll 20 recorded as $R_3$ is used as the edge guide roll 5. As a result, the walk force applied from the driven rolls 6 and 7 to the belt member 8 balances the walk force applied from the edge guide roll 5 to the belt member 8 with the directions of the two walk forces being opposite to each other, thereby preventing the occurrence of the belt walk due to the incompleteness of forming of the elastic rolls.

While the elastic rolls to be used as the edge guide roll 5 and the driven rolls 6 and 7 are decided according to the result of measurement on the directionality of finishing of each elastic roll 20 manufactured and its intensity in this preferred embodiment, the conditions of finishing may be preliminarily decided for the edge guide roll 5 and the driven rolls 6 and 7 to individually give specific directionalities of finishing and their intensities to the rolls 5, 6, and 7.

More specifically, the directionality of finishing of each elastic roll 20 is decided according to the direction of grinding or cutting of the elastic fins as mentioned above, and the intensity of the directionality is decided according to a parameter in grinding or cutting such as a tool feeding speed. Accordingly, specific directionalities of finishing and their intensities can be individually given to the edge guide roll 5 and the driven rolls 6 and 7 by setting specific finishing parameters for the rolls 5, 6, and 7 and finishing the elastic rolls 20 to be used as the rolls 5, 6, and 7 according to these parameters.

As the specific finishing parameters are individually set for the edge guide roll 5 and the driven rolls 6 and 7, it is unnecessary to make the measurement on the directionality of finishing of each elastic roll and its intensity as mentioned above, thereby allowing the belt feeding device to be immediately constructed.

Second Preferred Embodiment

While the belt feeding device according to this preferred embodiment is apparently the same as the belt feeding device according to the first preferred embodiment mentioned above, an elastic roll 30 shown in FIG. 5 is used as the edge guide roll 5 and the driven rolls 6 and 7.

Figure 5:
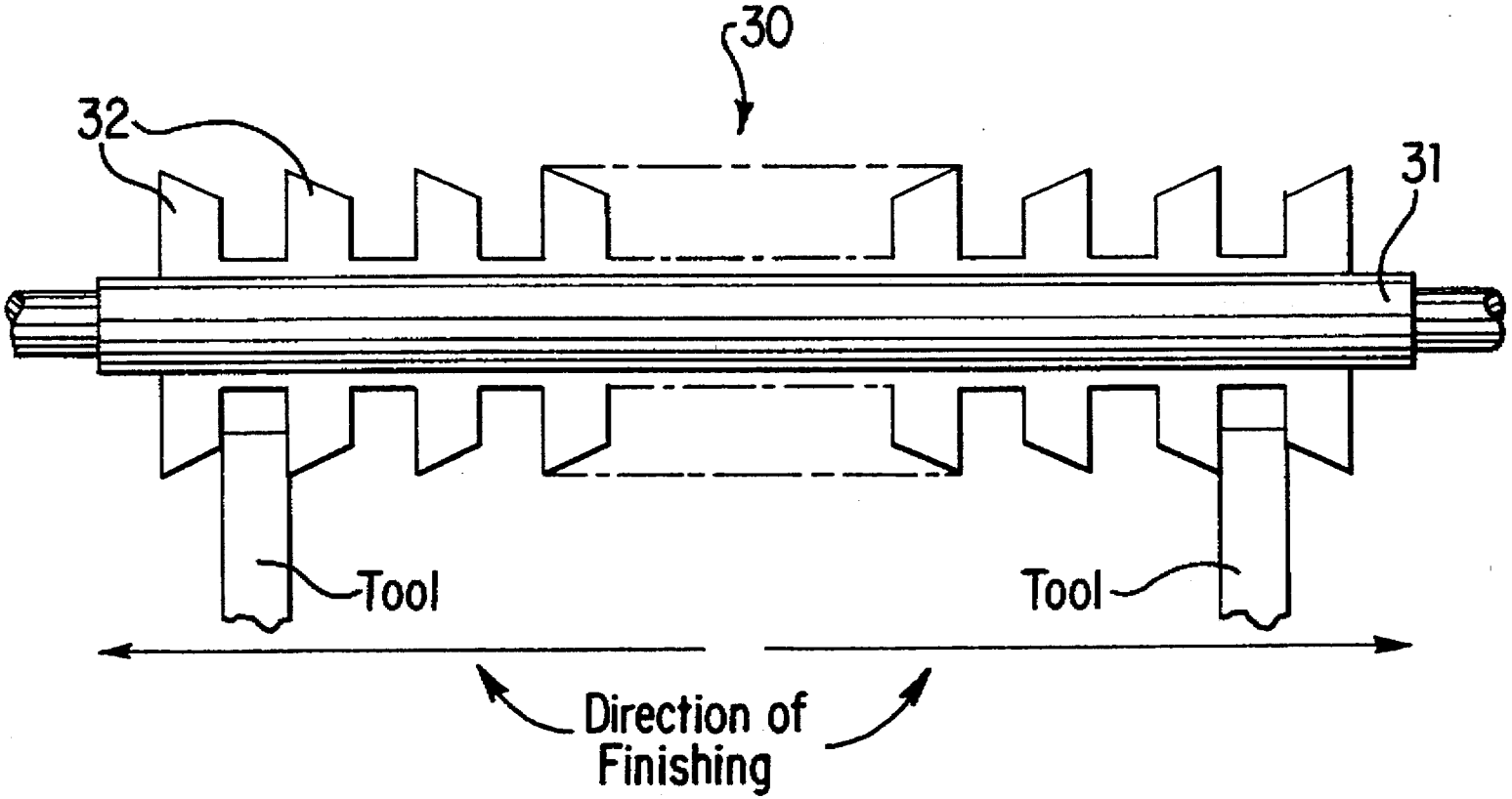
FIG. 5 is an elevational view of an elastic roll used in a second preferred embodiment of the belt feeding device of the present invention.

As similar to the first preferred embodiment, the elastic roll 30 is composed of a rotating shaft 31 and a plurality of disklike or disk shaped elastic fins 32 arranged in the axial direction of the rotating shaft 31. Each elastic fin 32 shown in FIG. 5 is circumferentially equally divided into a plurality of parts. The elastic roll 30 is formed by performing injection molding of rubber or soft synthetic resin around the rotating shaft 31 to form the elastic fins 32 and then grinding or cutting the outer circumferential surfaces of the elastic fins 32 to a given outer diameter.

This grinding or cutting is performed by feeding tools in a first direction between one axial end and the axial center of the elastic roll 30 and in a second direction opposite to the first direction between the axial center and the other axial end of the elastic roll 30. For example, when the right half of the elastic roll 30 is finished from the axial center to the right-hand end of the elastic roll 30 as shown by an arrow in FIG. 5, the left half of the elastic roll 30 is finished from the axial center to the left-hand end of the elastic roll 30 as shown by another arrow in FIG. 5. Alternatively, the right half of the elastic roll 30 may be finished from the right-hand end to the axial center, and the left half of the elastic roll 30 may be finished from the left-hand end to the axial center.

Accordingly, the elastic roll 30 has a first directionality of finishing (angle) of the elastic fins 32 between one axial end to the axial center and a second directionality of finishing of the elastic fins 32 opposite to the first directionality between the axial center and the other axial end. As a result, the walk force of the elastic roll 30 acting to move the belt member 8 from the front side to the rear side of the copying machine balances the walk force of the elastic roll 30 acting to move the belt member 8 from the rear side to the front side. That is, in feeding the belt member 8 wrapped around the elastic roll 30, no belt walk occurs in the belt member 8.

Accordingly, when the elastic roll 30 is used as the edge guide roll 5 and the driven rolls 6 and 7, the belt walk of the belt member 8 due to the incompleteness of forming of the elastic roll 30 can be prevented.

Third Preferred Embodiment

While the belt feeding device according to this preferred embodiment is also apparently the same as the belt feeding device according to the first preferred embodiment mentioned above, an elastic roll 40 shown in FIG. 6 is used as the edge guide roll 5 and the driven rolls 6 and 7.

Figure 6:
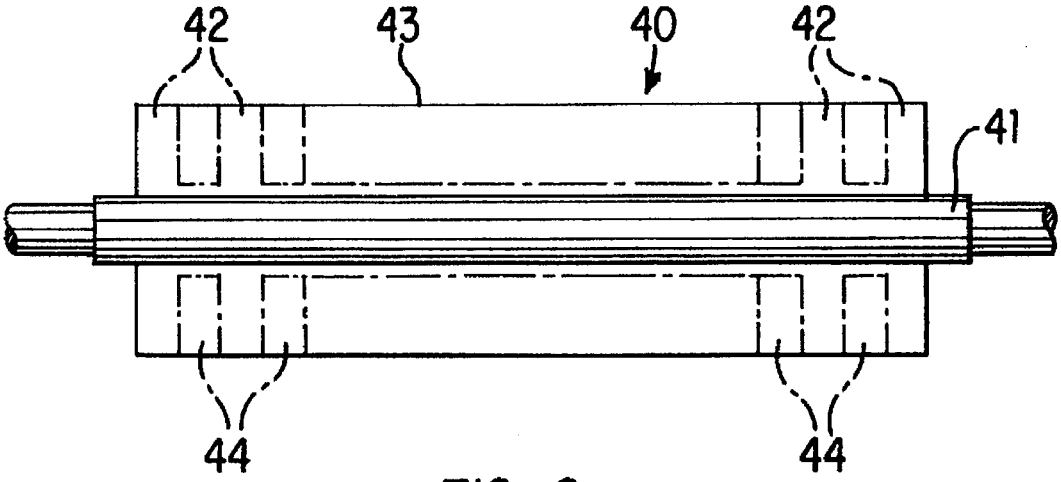
FIG. 6 is an elevational view of an elastic roll used in a third preferred embodiment of the belt feeding device of the present invention.

As similar to the first preferred embodiment, the elastic roll 40 is composed of a rotating shaft 41 and a plurality of disklike elastic fins 42 arranged in the axial direction of the rotating shaft 41. Each elastic fin 42 shown in FIG. 6 is circumferentially equally divided into a plurality of parts. However, unlike the first preferred embodiment, the elastic roll 40 is formed by padding rubber of soft synthetic resin around the rotating shaft 41 to form a columnar roll 43, next grinding or cutting the outer circumferential surface of the columnar roll 43 to have a given outer diameter thereof, and next forming a plurality of annular grooves 44 at axially equal intervals on the outer circumferential surface of the columnar roll 43 by cutting. That is, the elastic fins 42 are formed so as to radially project from the rotating shaft 41 by radially cutting the columnar roll 43.

According to this forming method for the elastic roll 40, the outer diameter of each elastic fin 42 is made identical with the outer diameter of the columnar roll 43 before the step of forming the annular grooves 44. Since the outer circumferential surface of the columnar roll 43 is not axially deformed in the grinding or cutting step unlike the elastic fins 42, the given outer diameter of the columnar roll 43 can be precisely obtained. Accordingly, there is no possibility that the outer circumferential surface of each elastic fin 42 may become tapered as shown in FIG. 9. As a result, the belt member 8 wrapped around the elastic roll 40 does not receive any walk force from the elastic roll 40.

Thus, the elastic fins 42 of the elastic roll 40 manufactured by the above-mentioned method have an ideal shape, and the belt walk due to the incompleteness of forming of the elastic roll does not occur in the belt feeding device according to this preferred embodiment using the elastic roll 40 as the edge guide roll 5 and the driven rolls 6 and 7.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A belt feeding device having a roll, said belt feeding device having a belt member supported by and revolvable around said roll, said roll comprising:

a plurality of disk-shaped fins having outer circumferential ends, said outer circumferential ends being angled with respect to a longitudinal axis of said roll and having outermost portions that are at a constant distance from the longitudinal axis of said roll.

2. The belt feeding device of claim 1, wherein each of said outer circumferential ends are angled in the same direction with respect to the axis of said roll.

3. The belt feeding device of claim 1, wherein the outer circumferential ends are angled in a first direction over a first longitudinal portion of the roll, and wherein the outer circumferential ends are angled in a second direction over a second longitudinal portion of the roll.

4. The belt feeding device of claim 3, wherein the first and second longitudinal portions are of substantially equal length.

5. The belt feeding device of claim 1, wherein said roll and said fins are formed of one of rubber and soft synthetic resin.

6. The belt feeding device of claim 1, wherein said roll is a first roll and said device comprises at least one second roll having outer circumferential ends facing opposite the circumferential ends of said first roll.

7. A belt feeding device that includes a roll-supported belt member, said belt feeding device comprising:

at least one first roll having disk-shaped fins having outer circumferential ends, said outer circumferential ends of said at least one first roll being angled in a first direction with respect to the axis of said first roll and having outermost portions that are at a constant distance with respect to the axis of said at least one first roll; and at least one second roll having disk-shaped fins having outer circumferential ends, said outer circumferential ends of said at least one second roll being angled in a second direction with respect to the axis of said first roll and having outermost portions that are at a constant distance with respect to the axis of said at least one second roll.

8. The belt feeding device of claim 2, wherein said rolls are formed of one of rubber and soft synthetic resin.

* * * * *